US007832622B2

(12) United States Patent
Spivey, Sr.

(10) Patent No.: US 7,832,622 B2
(45) Date of Patent: Nov. 16, 2010

(54) SIDE HANDLES FOR A CARTON

(75) Inventor: Raymond Rudolph Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 893 days.

(21) Appl. No.: 11/657,990

(22) Filed: Jan. 25, 2007

(65) Prior Publication Data

US 2007/0170232 A1 Jul. 26, 2007

Related U.S. Application Data

(60) Provisional application No. 60/761,812, filed on Jan. 25, 2006.

(51) Int. Cl.
*B65D 5/46* (2006.01)
*B65D 17/00* (2006.01)

(52) U.S. Cl. ..... 229/117.16; 229/242

(58) Field of Classification Search ..... 229/117.16, 229/117.14, 117.13, 922, 165, 180; 206/736, 206/139, 141, 155
See application file for complete search history.

(56) References Cited

U.S. PATENT DOCUMENTS 2,111,376 A 3/1938 Van Wingen
2,151,472 A * 3/1939 Hubbard ..... 229/120.36
4,621,766 A * 11/1986 McClure ..... 229/117.17
6,065,590 A 5/2000 Spivey
6,250,542 B1 * 6/2001 Negelen ..... 229/117.16
6,402,020 B1 6/2002 McClure
6,926,193 B2 8/2005 Smalley
2003/0080180 A1 * 5/2003 Holley et al. ..... 229/117.13
2005/0067477 A1 3/2005 McClure

FOREIGN PATENT DOCUMENTS

WO WO 99/28198 6/1999

* cited by examiner

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

A carton includes a plurality of panels that extend at least partially around an interior of the carton. The plurality of panels includes a first panel, and at least one end flap is foldably connected to the first panel. The end flap can include a handle opening and a handle panel adjacent to the handle opening. A reinforcement panel is in an overlapping relationship with at least a portion of the handle panel. The reinforcement panel may be adhered to the handle panel. The reinforcement panel can be foldably connected to an edge of the handle panel that is distant from the handle opening.

16 Claims, 6 Drawing Sheets

SIDE HANDLES FOR A CARTON

RELATED APPLICATION

This application claims the benefit of U.S. Provisional Application No. 60/761,812, filed Jan. 25, 2006, entitled "Side Handles for Carton," the entire disclosure of which is incorporated herein by reference.

BACKGROUND OF THE INVENTION

The present invention generally relates to a carrier or carton with handle features.

Cartons, such as paperboard cartons, used to hold, carry, or dispense articles are well known. These cartons usually are formed or assembled by folding a paperboard carton blank that has been cut and scored in selected areas to provide desired features and characteristics. These features often include tear lines, handles, opening features, dispensers, and other well-known attributes.

For example, a variety of carton handles are known. Nonetheless, there is always a desire for handles that provide a new balance of properties.

BRIEF SUMMARY OF SOME ASPECTS OF THE INVENTION

In accordance with one aspect of the present invention, handle features of a carton can help to ease the burden of lifting and carrying the carton. The handle features can be side handles that are disposed at opposite ends of the carton.

In accordance with another aspect of the present invention, the blank from which the carton can be erected can be configured to minimize the amount of paperboard utilized (e.g., as compared to conventional twin stack carton designs) while maintaining at least sufficient functionality.

According to one aspect of the present invention, a carton includes a plurality of panels that extend at least partially around an interior of the carton. The plurality of panels includes a first panel, and at least one end flap is foldably connected to the first panel. A reinforcement panel can be in an overlapping relationship with at least a portion of the end flap. More specifically, the reinforcement panel can be in an overlapping relationship with at least a portion of a handle panel, with the handle panel being a part of the end flap that typically is adjacent to a handle opening that is at least partially defined in the end flap. The reinforcement panel may be adhered to the handle panel. The reinforcement panel can be foldably connected to an edge of the handle panel that is distant from the handle opening. Optionally, a closure flap can be provided for closing the handle opening, and an edge of the reinforcement panel can extend along, and be shaped substantially like, at least a portion of an edge of the handle opening.

The first panel can be a bottom panel of the carton, and the end flap can be a bottom end flap. The plurality of panels, which extends at least partially around the interior of the carton, can include a side panel. A side end flap, which at least partially closes an end of the carton, can be foldably connected to the side panel. The reinforcement panel can be connected to (e.g., releasably adhered to) the side end flap. In one example, the reinforcement panel was originally struck from the side end flap.

The bottom end flap can include an intermediate panel that is positioned between the bottom panel and the handle panel. In one example, a connection (e.g., formed by adhesive material) between the intermediate panel and the side end flap is stronger than the connection (e.g., formed by adhesive material) between the reinforcement panel and the side end flap, so that the handle panel can be pivoted (e.g., folded) away from the side end flap while the intermediate panel remains connected to (e.g., adhered to) the side end flap.

The reinforcement panel can be a first reinforcement panel, and the edge of the handle panel, to which the first reinforcement panel is foldably connected, can be a first edge of the handle panel. The carton can further include a second reinforcement panel that is in an overlapping relationship with at least a portion of the handle panel. The second reinforcement panel can be foldably connected to a second edge of the handle panel that is distant from the handle opening, and the first and second edges of the handle panel can be opposite from one another.

In accordance with one aspect of the present invention, a carton includes a plurality of panels that extend at least partially around an interior of the carton, and first and second handle flaps are each at least indirectly pivotably connected to the plurality of panels for pivoting in opposite directions away from the plurality of panels. In accordance with this aspect, the handle flaps are spaced apart from one another, and each of the handle flaps defines a handle opening. Optionally, the handle openings are respectively closed by closure flaps that extend into the handle openings. The carton can include bottom end flaps respectively foldably connected to opposite ends of a bottom panel of the carton, with the first handle flap being connected (e.g., foldably connected) to one of the bottom end flaps, and the second handle flap being connected (e.g., foldably connected) to the other bottom end flap. Optionally, the handle flaps can be reinforced.

According to one aspect of the present invention, a blank includes a plurality of panels that are respectively foldably connected to one another, a first end flap foldably connected to a first panel of the plurality of panels, and a second end flap foldably connected to a second panel of the plurality of panels. The first end flap at least partially defines a handle opening, and the second end flap includes a reinforcement panel that is foldably connected to the first end flap. The blank can further include a third end flap foldably connected to a third panel of the plurality of panels, with the third end flap including a second reinforcement panel that is foldably connected to another edge of the first end flap.

In accordance with another aspect of the present invention, a blank includes a plurality of panels that are respectively foldably connected to one another, and first and second end flaps are respectively connected to first and second panels of the plurality of panels. The first end flap comprises a handle panel, which may have a handle opening proximate thereto. A reinforcement panel is in an overlapping relationship with, and adhered to, at least a portion of the handle panel. The reinforcement panel was struck from the second end flap, so that the second end flap defines an opening at least partially resulting from the reinforcement panel having been struck from the second end flap. The reinforcement panel may be foldably connected to an edge of the first end flap.

A second reinforcement panel can be in an overlapping relationship with, and adhered to, at least a portion of the first end flap. The second reinforcement panel was struck from a third end flap, so that the third end flap defines an opening at least partially resulting from the second reinforcement panel having been struck from the third end flap.

One aspect of the present invention is the provision of a method of forming a construct, such as a carton or an improved blank, from an initial blank. In accordance with an exemplary method, a blank is provided so that the blank includes a plurality of panels that are respectively foldably connected to one another, a first end flap foldably connected to a first panel of the plurality of panels, and a second end flap foldably connected to a second panel of the plurality of panels. The first end flap at least partially defines a handle opening, and the second end flap includes a reinforcement panel that is foldably connected to the first end flap. The exemplary method includes forming a reinforced handle. The forming of the reinforced handle can include arranging the first end flap and the reinforcement panel in an overlapping arrangement with respect to one another so that the reinforcement panel reinforces at least a portion of the first end flap that is proximate the handle opening. The arranging can include folding the reinforcement panel relative to the first end flap. In one example, the arranging includes striking the reinforcement panel from the second end flap. The striking can include tearing along at least one tear line that at least partially defines the reinforcement panel in the second end flap.

The method can further include pivoting the reinforced handle relative to other portions of the carton, and lifting the carton at least by the reinforced handle.

Other aspects and advantages of the present invention will become apparent from the following.

BRIEF DESCRIPTION OF THE DRAWINGS

Having described some aspects of the invention in general terms, reference will now be made to the accompanying drawings that illustrate an exemplary embodiment of the present invention, are not necessarily drawn to scale, may be schematic, and are briefly described below:

FIG. 3 can be characterized as illustrating a portion of an improved blank that is formed from the blank of FIG. 1.

DETAILED DESCRIPTION OF EXEMPLARY EMBODIMENT

Referring now in greater detail to the drawings, in which like numerals refer to like parts throughout the several views, reference is made in the following to constructs, namely blanks, a carton, and a package, according to an exemplary embodiment the present invention.

Figure 1:
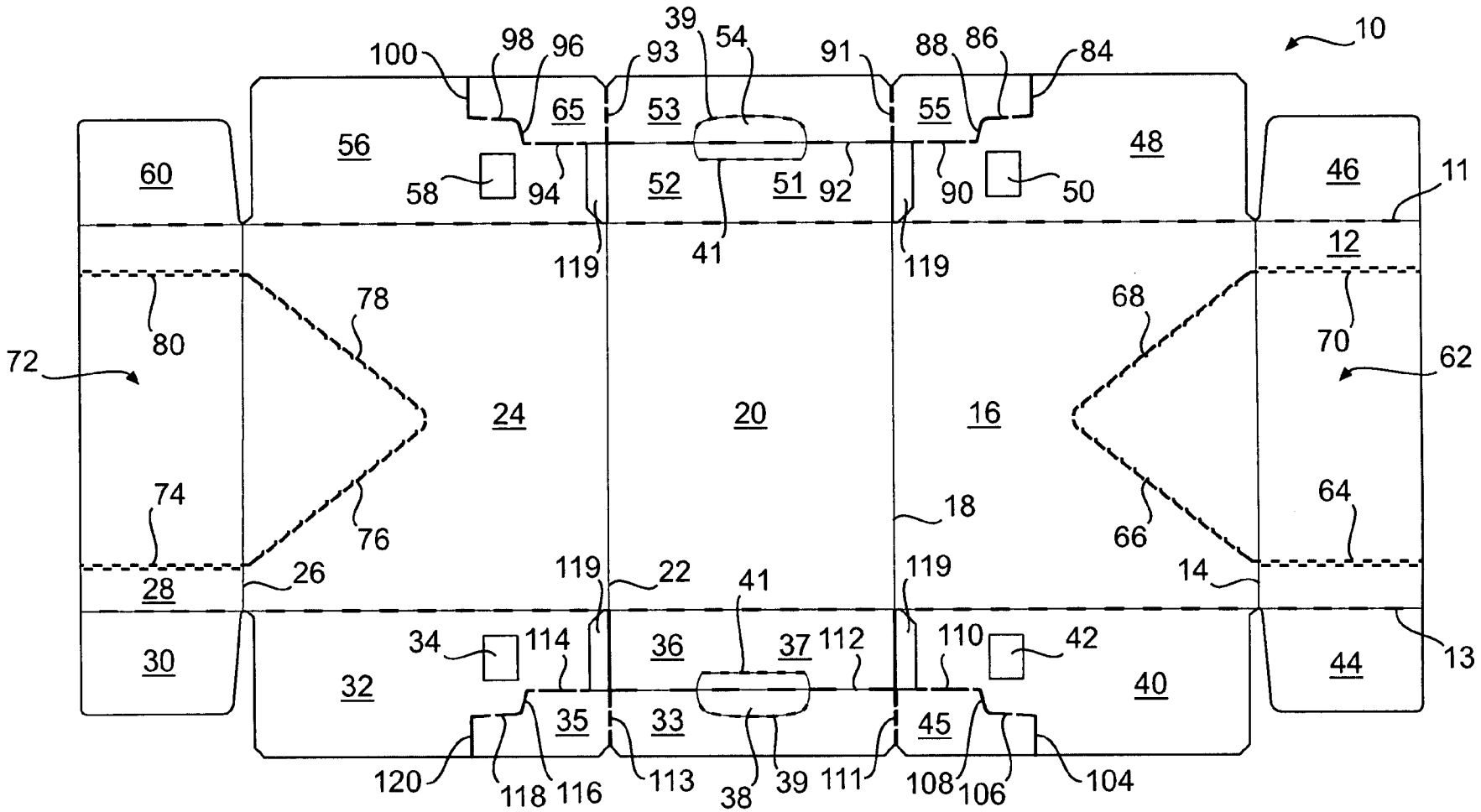
FIG. 1 is a plan view of a blank from which a carton can be formed.

FIG. 1 illustrates a blank 10 that can be formed into a carton (FIGS. 6-9), in accordance with the exemplary embodiment of the present invention. Referring to the blank 10 of FIG. 1 in greater detail, it includes a first top panel 12 connected to a side panel 16 by a fold line 14. The side panel 16 is connected to a bottom panel 20 at a fold line 18. The bottom panel 20 is connected to a side panel 24 by a fold line 22. The side panel 24 is connected to a second top panel 28 by a fold line 26. The blank 10 also includes one or more end flaps respectively at a peripheral portions of the panels 12, 16, 20, 24, 28, and in FIG. 1 the end flaps are respectively foldably connected to the panels by fold lines 11, 13 that extend between the ends of the blank 10. At least some of the end flaps are optional. More specifically and as shown in FIG. 1, top end flaps 30, 60 are foldably attached to the opposite ends of the second top panel 28, end flaps 32, 56 are foldably connected to opposite ends of the side panel 24, bottom end flaps 36, 52 are foldably attached to opposite ends of the bottom panel 20, side end flaps 40, 48 are foldably attached to opposite ends of the side panel 16, and top end flaps 44, 46 are foldably attached to opposite ends of the first top panel 12.

Pivotably attached closure flaps 38, 54 are respectively formed in the bottom end flaps 36, 52 for closing/opening respective handle openings. The closure flaps 38, 54 can be characterized as being optional, because they could be omitted so that the handle openings that are closed by the closure flaps are not closed by closure flaps. For example, the closure flap 54 is omitted in FIGS. 2 and 3 so that its associated handle opening is seen. Each of the closure flaps 38, 54 can be defined, for example, by tear line(s) and/or slit(s) that extend between opposite ends of a fold line, so that the closure flap can be pivoted (e.g., folded) at its fold line. For example and as shown in FIG. 1, each of the closure flaps 38, 54 is defined by a fold line 41, and a generally U-shaped slit or tear line 39 that extends between opposite ends of the fold line 41. Typically, the closure flaps 38, 54 will be configured so that they are manually deployed in a manner that cushions a user's grip on the handles of the carton erected from the blank 10, as will be discussed in greater detail below. Differently configured closure flaps 38, 54 and handle openings are within the scope of the present invention. For example and alternatively, each closure flap 38, 54 can be in the form of two or more closure flaps.

Glue locators are schematically designated as rectangles identified by numerals 34, 42, 50, and 58 on the side end flaps 32, 40, 48, 56, although differently shaped glue locators can be used. Very generally described, each glue locator 34, 42, 50, 58 can be characterized as a target area for receiving adhesive material. More specifically and in accordance with one example, each glue locator can be characterized as providing a "50% glue location site", although this percentage can vary with 50% being provided as exemplary only. In one example, each glue locator 34, 42, 50, 58 can be cut 50% around its perimeter, although this percentage can also vary as desired, to allow top layer(s) of the paperboard at the glue locators 34, 42, 50, 58 to separate and be removed with the adhesive material adhered thereto, as will be discussed in greater detail below. In one specific example, the glue locators 34, 42, 50, 58 can be defined by (e.g., circumscribed by) kiss-cuts that extends through about 50%, or another effective amount, of the thickness of the blank 10, so a partial thickness of the blank at the glue locators tears from the end flaps 32, 40, 48, 56 and remains with adhesive material adhered thereto, as will be discussed in greater detail below. As also discussed in greater detail below, the glue locators 34, 42, 50, 58 can be omitted or replaced with other features.

FIG. 1 also shows optional opening features 62 and 72 that can be at least partially torn away from the carton erected from the blank 10, to provide dispenser openings through which contents can be removed from the interior of the carton. In general, the opening feature 62 is defined by one or more tear lines, which can be continuous or discontinuous. More specifically, the opening feature 62 can be characterized as being partially defined by tear lines 64, 70 that are in the top panel 12, and are shown as being substantially parallel to the fold lines 11, 13. The opening feature 62 can be further characterized as being defined by tear lines 66, 68 that are located in the side panel 16 and extend obliquely/convergently from the tear lines 64, 70 in the top panel 12. The tear lines 66 and 68 respectively intersect with the tear lines 64 and 70 at the fold line 14. The tear lines 66 and 68 extend diagonally and meet each other in a central portion of the side panel 16. Additional opening features, such as finger flaps or other features can be included to assist in the separation of the opening feature 62 from the blank 10 or carton formed therefrom, with such additional opening features typically being included somewhere along one of the tear lines such as adjacent the intersection of the tear lines 66 and 68.

The opening feature 72 is shown in FIG. 1 as being substantially similar to (e.g., a mirror image of) the opening feature 62. The opening feature 72 is defined by one or more tear lines, which can be continuous or discontinuous. More specifically, the opening feature 72 can be characterized as including tear lines 74, 80 that extend in the top panel 28 and are parallel to the fold lines 11, 13. The opening feature 72 can be further characterized as being defined by tear lines 76, 78 that are located in the side panel 24 and extend obliquely/convergently from the tear lines 74, 80 that extend in the top panel 28. The tear lines 76 and 78 respectively intersect the tear lines 74 and 80 at the fold line 26. The tear lines 76 and 78 extend in a generally diagonal direction to meet each other in a central portion of the side panel 24. Additional opening features, such as finger flaps, can be included with the opening feature 72, such as at the intersection of the tear lines 76 and 78.

In accordance with the exemplary embodiment of the present invention, the carton erected from the blank 10 includes reinforced handle flaps 82, 102 (FIGS. 3-9) that include reinforcement features for increasing the strength of the handle flaps or areas adjacent the handle flaps. The reinforced handle flaps 82, 102 include several reinforcement features that are included in blank 10 and that can be folded upon one another during the manufacturing process to increase the strength of the handles.

Figure 2:
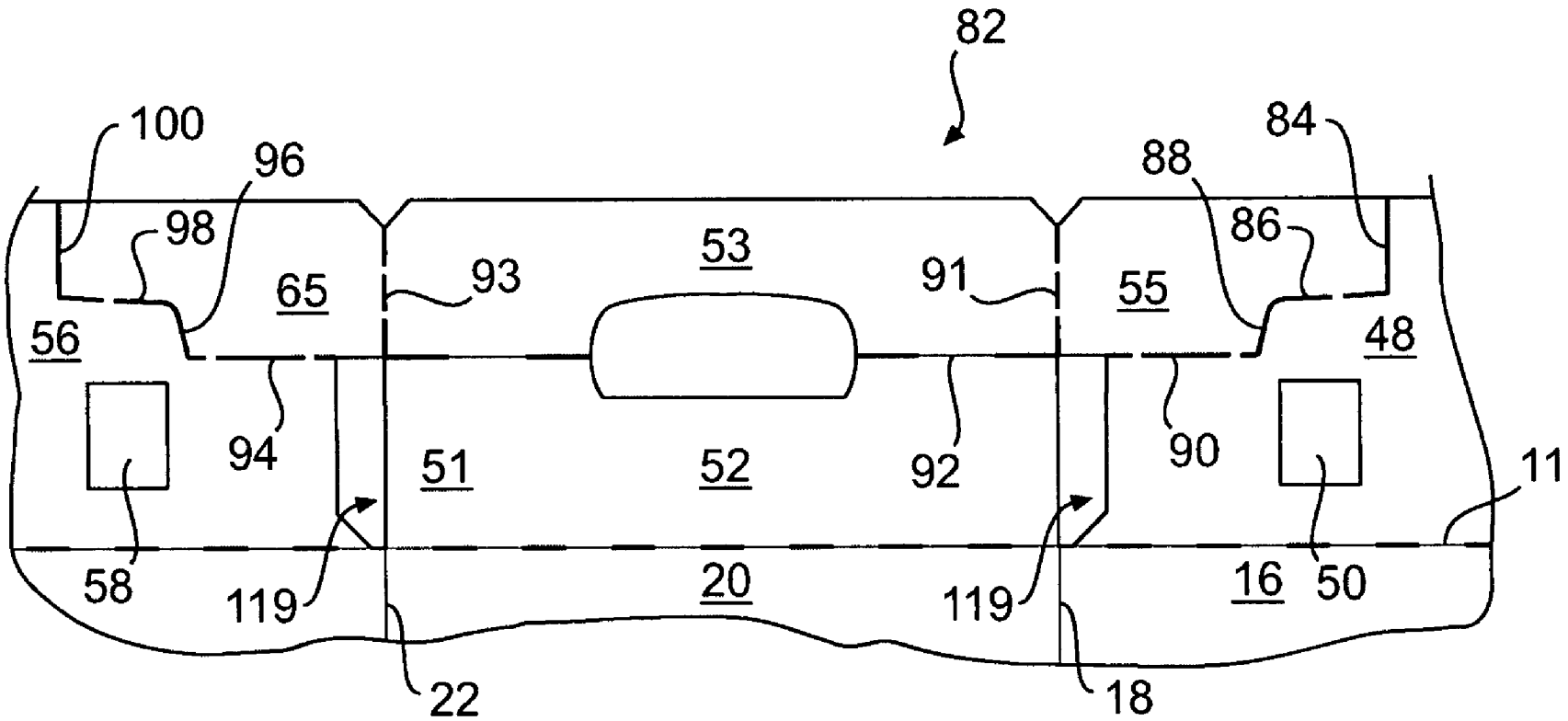
FIG. 2 is an enlarged view of a portion of the blank of FIG. 1.
Figure 3:
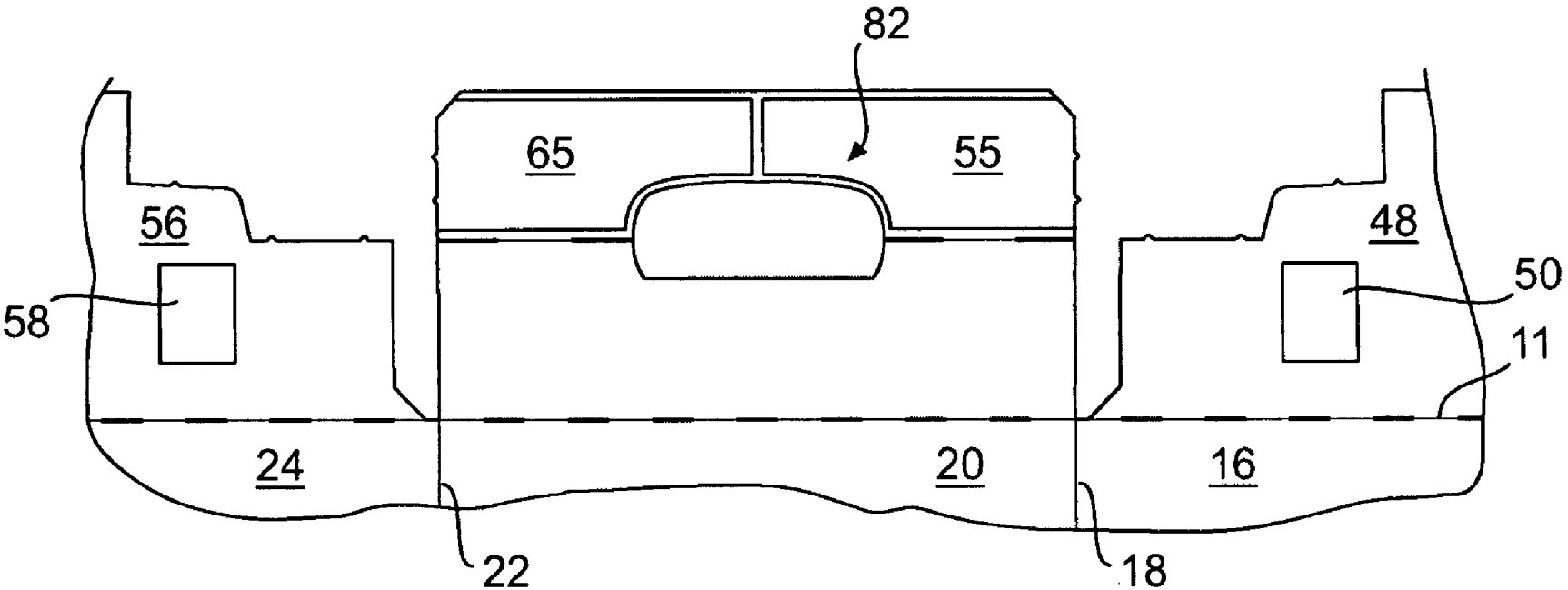
FIG. 3 is illustrates the portion shown in FIG. 2, with reinforcement panels having been folded inward to reinforce the handle.

As can be understood with reference to FIGS. 2 and 3, the reinforced handle flap 82 includes a handle panel 53 that is a portion of the end flap 52, or is an additional segment of the end flap 52. More specifically and is shown in FIGS. 1 and 2, the end flap 52 can be characterized as including an intermediate portion 51 that is foldably connected to the bottom panel 20 at the fold line 11, and foldably connected to the handle panel 53 at a fold line 92. As shown in FIG. 1, the fold line 92 extends across the closure flap 54. A handle reinforcement portion 55 is defined by slits and/or tear lines such as tear lines 84, 86, 88, and 90 that extend in the side end flap 48, and another tear line or fold line 91 that foldably connects the reinforcement portion 55 to the handle panel 53. The tear lines 86 and 88 define a profile that is substantially similar to the profile of a corresponding portion of the closure flap 54/handle opening that is closed by the closure flap 54. Therefore, when the reinforcement portion 55 is separated from (e.g., struck from) the side end flap 48 along the tear lines 84, 86, 88, 90, and folded (e.g., pivoted) about the fold line 91 onto the handle panel 53, the edges resulting from the tearing along the tear lines 86 and 88 substantially extend along and are shaped substantially like adjacent edges of the handle opening associated with the closure flap 54. As shown in FIG. 3, the side end flap 48 defines an opening at least partially resulting from the reinforcement portion 55 having been struck from the side end flap 48.

Similarly, a reinforcement panel 65 is defined by tear lines 94, 96, 98, 100, which are in the end flap 56, and a tear line or fold line 93. The tear lines 96 and 98 define a profile that is substantially similar to the profile of a corresponding portion of the closure flap 54/handle opening that is closed by the closure flap 54. Therefore, when the reinforcement panel 65 is separated from (e.g., struck from) the side end flap 56 along the tear lines 94, 96, 98, 100, and folded about the fold line 93, the edges resulting from the tearing along the tear lines 96 and 98 substantially extend along and are shaped substantially like adjacent edges of the handle opening associated with the closure flap 54. As shown in FIG. 3, the side end flap 56 defines an opening at least partially resulting from the reinforcement portion 65 having been struck from the side end flap 56.

Similarly, features for forming the reinforced handle flap 102 (FIGS. 4-9) are shown in FIG. 1, and the reinforced handle flap 102 is substantially similar to the reinforced handle flap 82. For example, a fold line 112 in the bottom end flap 36 demarcates a handle panel 33 of the bottom end flap 36. The handle panel 33 can be characterized as being a part of the bottom end flap 36, and/or the handle panel 33 can be characterized as being foldably connected to the bottom end flap 36 by the fold line 112, and/or the handle panel 33 can be characterized as being foldably connected to an intermediate portion 37 of the bottom end flap by the fold line 112. As shown in FIG. 1, the fold line 112 extends across the closure flap 38, although other arrangements can be suitable. For example, the fold lines 112, 92 may be omitted, such as from the closure flaps 38, 54.

Tear lines 104, 106, 108, and 110, together with a tear line or fold line 111, define a reinforcement panel 45 that is shown in the blank 10 as a segment of end flap 40. Detachment of the reinforcement portion 45 along the tear lines 104, 106, 108, and 110 (e.g., striking of the reinforcement portion 45 from the side end flap 40) allows the reinforcement portion 45 to be pivoted (e.g., folded) about the fold line 111, so that the reinforcement portion 45 reinforces the handle panel 33. The tear lines 106 and 108 substantially correspond in shape to the outline of a portion of the closure flap 38 and/or the handle opening associated with the closure flap 38.

Tear lines 114, 116, 118, and 120, together with a tear line or fold line 113, define a reinforcement panel 35 that is shown in FIG. 1 as being a segment of the side end flap 32. Detachment along the tear lines 114, 116, 118, and 120 (e.g., striking of the reinforcement portion 35 from the side end flap 32) allows the reinforcement panel 35 to be folded about the fold line 113 to overlie the handle panel 33. In this overlying configuration, the edges resulting from tearing along the tear lines 116 and 118 have a profile that follows along and substantially corresponds to the profile of a corresponding portion of the closure flap 38/associated handle opening, similar to as was discussed above regarding tear lines 96 and 98 in reference to the closure flap 54. Optionally, cut-outs/openings 119 can respectively be adjacent to, and partially define the shape, each of, the reinforcement panels 35, 45, 55, 65.

In accordance with the exemplary embodiment of the present invention, after the blank 10 has been formed, a forming or other machine detaches (e.g., strikes) the reinforcement panels 35, 45, 55, 65 along their respective tear lines and pivots them to create reinforcement. The reinforcement panels 35 and 45 can be folded over and adhered to the handle panel 33 to provide reinforcement thereto, and the reinforcement portions 55 and 65 can be folded onto and adhered to the handle panel 53 to provide reinforcement thereto, to respectively form the reinforced handle flaps 82, 102. Typically, the reinforced handle flaps 82, 102 will be formed in the blanks prior to (e.g., immediately prior to or a long time prior to) erecting the blanks into cartons. Accordingly and in accordance with one aspect of the present invention, a blank that includes formed handle flaps 82, 102 can still be referred to as a blank.

In accordance with an alternative embodiment of the present invention, the handle flaps 82, 102 are not reinforced. In this case, they can respectively consist essentially of the handle panels 53, 33

An acceptable method for erecting a carton from a blank, after the reinforced handle flaps 82, 102 have been formed in the blank, is described in the following, in accordance with the exemplary embodiment of the present invention. The blank is folded, such as along fold lines 18 and 26, so that there is an overlapping arrangement between portions of the top panels 12, 28, and the overlapped portions of the top panels 12, 28 are secured together by adhesive material or other means to form a sleeve. Then, the sleeve is opened by folding along the fold lines 14, 18, 22, 26, so that the panels 12, 16, 20, 24, 28 extend around the interior of the open sleeve/carton. Cans C or other articles can be inserted into the interior of the open sleeve. The opposite ends of the sleeve are respectively closed with the end flaps 30, 32, 36, 40, 44, 46, 48, 52, 56, 50, which can be respectively secured to one another with adhesive material or other attachment mechanisms.

Figure 4:
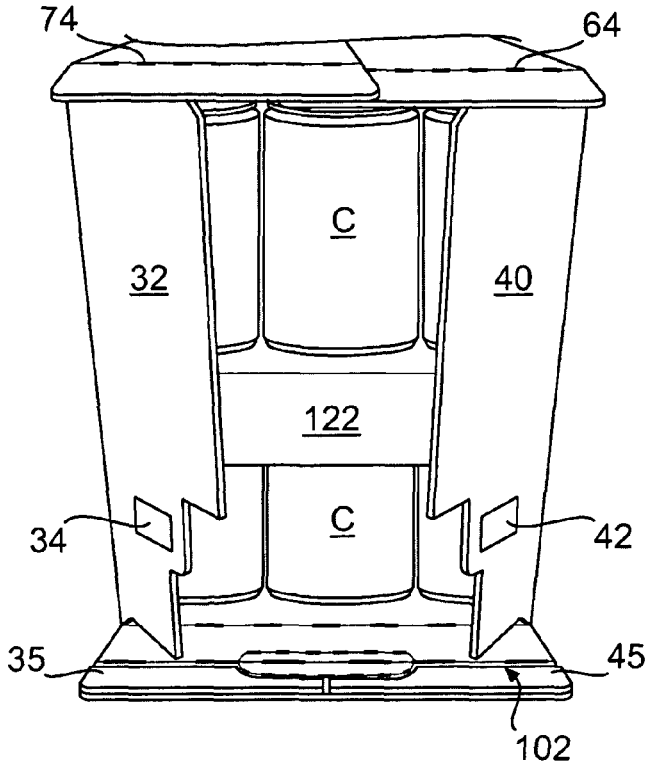
FIG. 4 shows a carton erected from the blank of FIG. 3, with an end of the carton being partially open and articles in the interior carton.

For example, FIG. 4 shows a partially open carton formed from the blank 10, with cylindrical beverage containers C loaded therein, although the invention is not limited to such containers C or contents. In FIG. 4, the carton is housing two levels of containers C separated by a divider pad 122, which can be conventional. The end illustrated in FIG. 4 is partially closed by folding the side end flaps 32, 40 inwardly, for example so that they abut the downwardly extending flap of the optional divider pad 122. The upper end flaps 30, 40 are folded downwardly and respectively securely adhered to the closed side end flaps 32, 40. The bottom end flap 36 with the reinforced handle 102 is folded inwardly so that the intermediate portion 37 of the bottom end flap 36 abuts lower portions of the side end flaps 32, 40, and the reinforcement panels 35, 45 of the reinforced handle 102 also abut the side end flaps 32, 40. The intermediate portion 37 of the bottom end flap 36 is securely adhered to the side end flaps 32, 40, such as by way of adhesive material interposed between the intermediate portion 37 and the side end flaps 32, 40. The reinforcement panels 35, 45 of the reinforced handle 102 are releasably adhered to the side end flaps 32, 40, such as by way of adhesive material interposed between the reinforcement panels 35, 45 and the side end flaps 32, 40.

Figure 5:
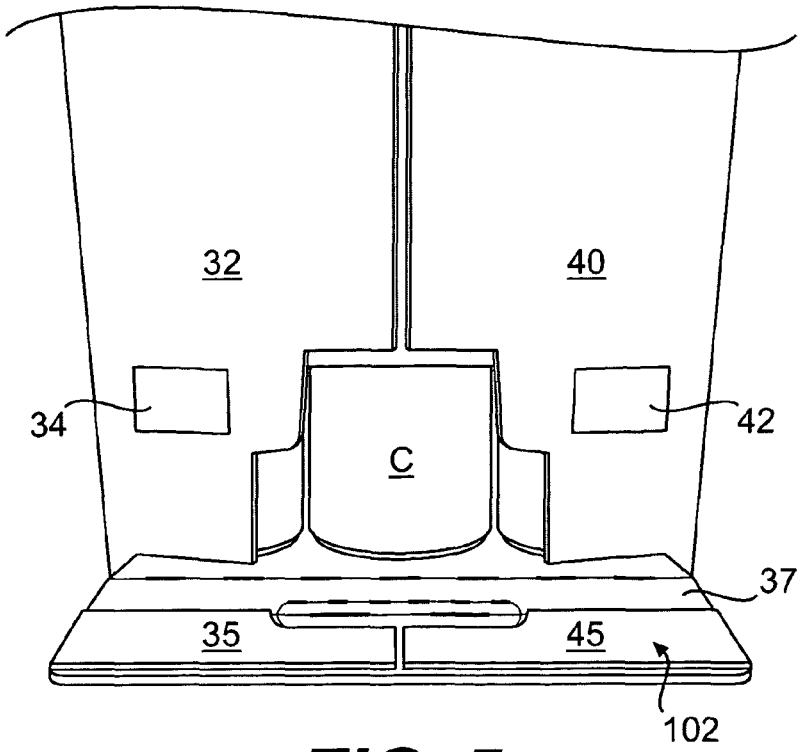
FIG. 5 is a partial view of the end shown in FIG. 4, with the end being farther closed and glue locators being schematically illustrated by rectangles.

Referring to FIG. 5, the releasable adhesion between the reinforcement panels 35, 45 of the reinforced handle 102 and the side end flaps 32, 40 can be provided by way of the glue locators 34, 42. In accordance with the exemplary embodiment of the present invention, the reinforcement panels 35, 45 of the reinforced handle 102 are adhered to the side end flaps 32, 40 solely at the glue locators 34, 42, so that this adhesion is releasable. For example, the glue locators 34, 42 can be cut (e.g., kiss-cut, or otherwise cut) so that at least portions of the glue locators 34, 42 (e.g., top layer(s) of the paperboard, or the like) can separate from the side end flaps 32, 40 when the adhesive material that is adhered to the glue locators 34, 42 is pulled (e.g., pivoted) away from the side end flaps 32, 40, as will be discussed in greater detail below.

The other end of the carton is closed in a manner like that described above. That is and in accordance with the exemplary embodiment of the present invention, the reinforced handles 82, 102 are respectively adhered to the side end flaps 32, 40, 48, 56 solely at the glue locators 34, 42, 50, 58, so that the reinforced handles 82, 102 are respectively releasably attached (e.g., releasably adhered) to the side end flaps 32, 40, 48, 56. Alternatively, the reinforced handles 82, 102 are respectively releasably attached to the side end flaps 32, 40, 48, 56 by way of any other mechanism (e.g., by using a releasable adhesive, or by adhering to a release coating, or any combination thereof or by any other suitable mechanism) that is sufficient for allowing the functionalities described herein. As another alternative, all adhesion between the reinforced handles 82, 102 and the side end flaps 32, 40, 48, 56 may in some situations be omitted.

Figure 6:
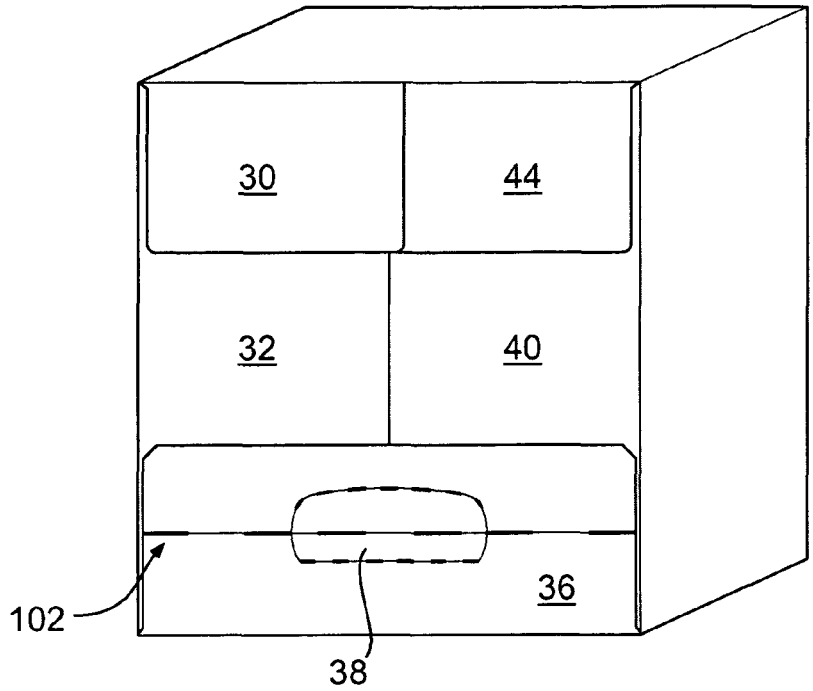
FIG. 6 shows the end of FIGS. 4 and 5 fully closed.
Figure 7:
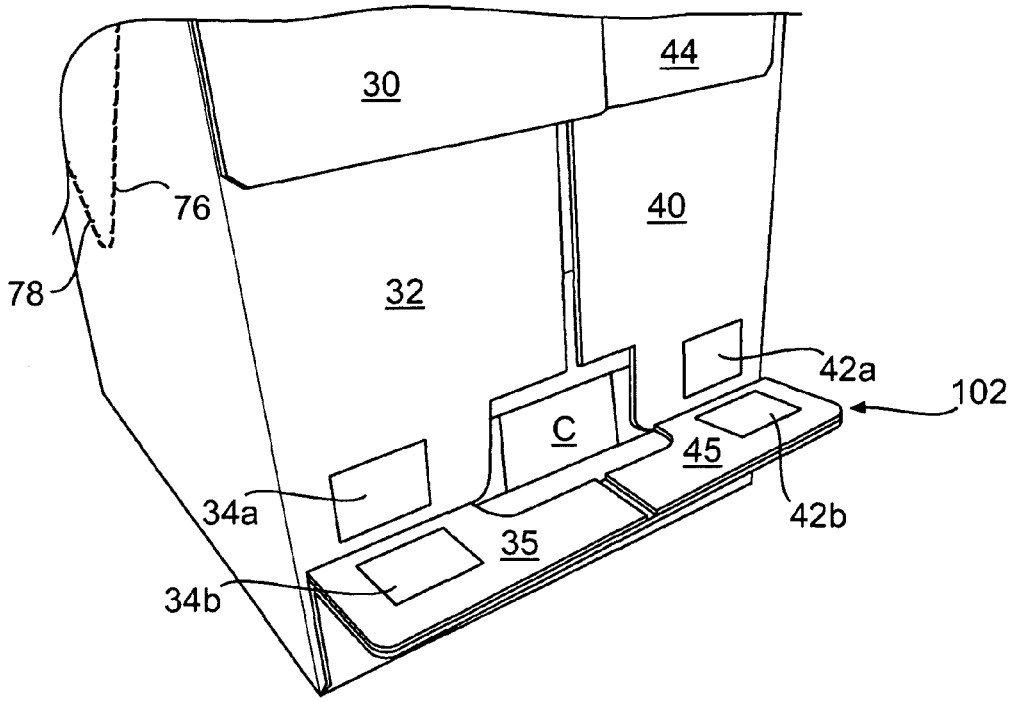
FIG. 7 shows the end of FIG. 6 with a reinforced handle flap partially detached and pivoted outwardly, so that it can be used in lifting the carton.

FIG. 6 shows the fully erected, loaded and closed carton. FIG. 7 shows the carton with the reinforced handle flap 102 having been partially detached. In order to partially detach the reinforced handle flap 102/move it from its closed position shown in FIG. 6 to the open position shown in FIG. 7, the handle flap 102 is pivoted downwardly, such as along the fold line 112, or another line. The handle flap 102 detaches from the side end flaps 32, 40 at the glue locators 34, 42, such as by way of portions of the glue locators 34, 42 tearing away from the side end flaps 32, 40. For example, remnants of the glue locators 34, 42 are designated by 34*a*, 34*b*, 42*a* and 42*b* in FIG. 7. As mentioned above, the handle flap 102 can be releasably adhered to or otherwise connected to the side end flaps 32, 40 by way of features other than the glue locators 34, 42, and in an alternative embodiment the direct connection between the handle flap 102 and the side end flaps 32, 40 may be completely omitted.

In accordance with the exemplary embodiment of the present invention, prior to detachment of the handle flaps 82, 102, typically, the adhesion between the intermediate portions 37, 51 of the bottom end flaps 36, 52 and the side end flaps 32, 40, 48, 56 is more secure/stronger than the adhesion between the handle flaps 82, 102 and the side end flaps 32, 40, 48, 56, so that the intermediate portions 37, 51 of the bottom end flaps 36, 52 remain adhered to the side end flaps 32, 40, 48, 56 when the handle flaps 82, 102 are detached from the side end flaps 32, 40, 48, 56. Alternatively, the intermediate portions 37, 51 of the bottom end flaps 36, 52 can detach from the side end flaps 32, 40, 48, 56 along with the handle flaps 82, 102, in which case the fold lines 92, 112 may be omitted from the bottom end flaps 36, 52.

Figure 8:
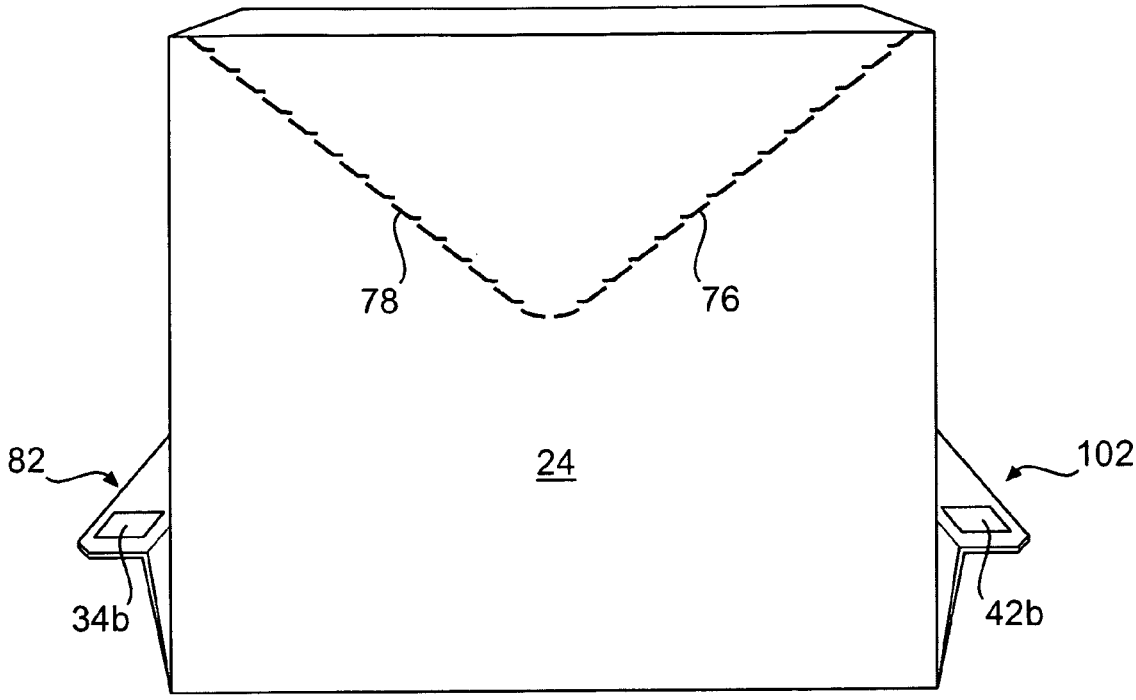
FIG. 8 shows the fully erected carton with both of the reinforced handle flaps partially detached and pivoted outwardly, so that they can be used to lift the carton.
Figure 9:
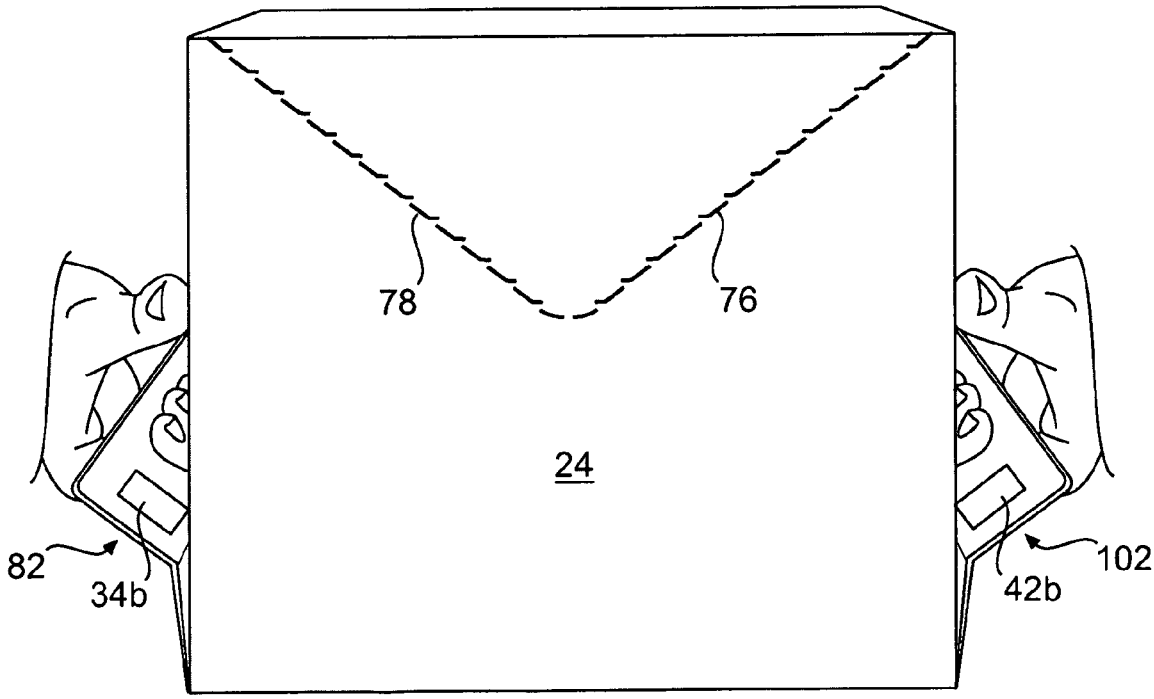
FIG. 9 is like FIG. 8, except that a user is shown lifting the carton from the reinforced handle flaps.

FIG. 8 shows the fully erected carton with the handle flaps 82, 102 having been detached/pivoted in opposite directions downwardly relative to the remainder of the carton, and the initial downwardly pivoting typically involves unadhering the handle flaps from the side end flaps 32, 40, 48, 56, as discussed above. Glue locators remnants 34*b*, 58*b* are shown in FIG. 8, although they are optional as discussed above. As shown in FIG. 9, a user's fingers have been inserted through the handle openings to facilitate lifting of the carton. In accordance with one acceptable example, the user's fingers can be inserted through the handle openings by manually pivoting the closure flaps 38, 54 inwardly to open the handle openings so that the inwardly pivoted closure flaps 38, 54 cushion the user's grip on the handle flaps 82, 102, although the closure flaps 38, 54 may be omitted or configured differently.

In accordance with the exemplary embodiment of the present invention, the carton can be opened by at least partially tearing the opening feature 62 and/or the opening feature 72 from the carton, such as by tearing along one or more of the tear lines that define the opening feature(s), although other methods and features for opening are also within the scope of the present invention.

In the drawing figures herewith, the handle flaps 82, 102 are located at a lower portion of the carton, namely at each bottom end flap 36, 52; however, the present invention is not limited to this arrangement or orientation. Accordingly, the handle flaps could be disposed at different elevational levels and locations. In addition, whereas the handles have been shown and described as being in the form of flaps, the flap-like functionality of the handle flaps may be omitted in some situations, such that the handles are stationary with respect to the remainder of the carton rather than being flaps for pivoting with respect to the remainder of the carton. Further, the carton as shown in the drawing figures can be oriented to rest on any side. When this occurs, the handles can be seen on the side panels, top and bottom panels, or any combination thereof. Further, the handle feature(s) could be created in only one end panel in lieu of both end panels as shown in the drawing figures, and other configurations are contemplated.

In the embodiment shown in the drawing figures, the carton is shown as accommodating cans or other substantially cylindrical packaged articles or products. Other types of articles, such as bottles or boxes, however, can be accommodated within a package according to the present invention. The dimensions of the blank also may be altered, for example, to accommodate various products, articles, etc.

In accordance with the exemplary embodiment of the present invention, the blanks can be formed from paperboard, corrugated cardboard or other materials having properties suitable for at least generally enabling respective functionalities described above. Paperboard is typically of a caliper such that it is heavier and more rigid than ordinary paper, and corrugated cardboard is typically of a caliper such that it is heavier and more rigid than paperboard. Typically, at least the side of the paperboard or cardboard that will be an exterior surface in the carton erected therefrom will be coated with a clay coating, or the like. The clay coating can be printed over with product, advertising, price-coding, and other information or images. The blanks may then be coated with a varnish to protect any information printed on the blanks. The blanks may also be coated with, for example, a moisture barrier layer, on one or both sides. The blanks can also be laminated to or coated with one or more sheet-like materials.

In accordance with the exemplary embodiment of the present invention, a fold line can be any at least somewhat line-like arranged, although not necessarily straight, form of weakening that facilitates folding therealong; and a tear line can be any at least somewhat line-like arranged, although not necessarily straight, form of weakening that facilitates tearing therealong. More specifically, but not for the purpose of narrowing the scope of the present invention, conventional fold lines include: a crease, such as formed by folding; a score line, such as formed with a blunt scoring knife, or the like, which creates a crushed portion in the material along the desired line of weakness; a slit that extends partially into the material along the desired line of weakness, and/or a series of spaced apart slits that extend partially into and/or completely through the material along the desired line of weakness; or various combinations of these features. More specifically, but not for the purpose of narrowing the scope of the present invention, conventional tear lines include: a slit that extends partially into the material along the desired line of weakness, and/or a series of spaced apart slits that extend partially into and/or completely through the material along the desired line of weakness, or various combinations of these features.

As a more specific example, one type of conventional tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like.

In accordance with the exemplary embodiment of the present invention, both fold lines and tear lines can be more generally referred to as lines of disruption.

For purposes of illustration, the exemplary embodiment of the present invention has been disclosed as a paperboard carton configured for containing containers, such as cans, in its interior. It will be understood that while the carton illustrated in the drawing figures generally is shown as a certain sized carton, the present invention is not limited to any specific size or dimension. For example, the carton of the present invention would work satisfactorily if sized and shaped to hold articles of other configurations, including thinner, thicker, and/or more irregularly shaped articles. Features of the present invention can also be used in cartons that include various other features, including opening features that provide easy access to the articles, tilt features that position the articles and carton, additional handle features, multiple openings, other opening or handle features, etc. Further, different shaped cartons, including nonrectangular or non-square or non-parallelepiped cartons and hexagonal cartons, are also within the scope of the present invention.

Also for purposes of illustration, the exemplary embodiment of the present invention has been shown with tear lines defining opening features opening features 62, 72. However, the present invention is not limited to any specific opening features, or openings formed by the opening features. In addition and more generally, the disclosed opening features and associated dispenser openings can be characterized as being optional (i.e., they could be omitted), since the contents of the carton (e.g., articles such as cans, bottles, or the like) could be accessed by other means, such as by opening the end flaps, by a pour spout, by differently configured opening features or other mechanisms.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A carton comprising:

a plurality of panels that extend at least partially around an interior of the carton, the plurality of panels including a first panel;

at least one end flap foldably connected to the first panel along a first fold line, the at least one end flap at least partially defining a handle opening; the at least one end flap being divided by a second fold line into a handle panel and an intermediate panel; the intermediate panel positioned between the first fold line and the second fold line; and a first reinforcement panel in an overlapping relationship with at least a first portion of the handle panel, wherein the first reinforcement panel is proximate the handle opening, the first reinforcement panel is foldably connected to an edge of the end flap, and the edge of the end flap is distant from the handle opening, wherein the first reinforcement panel is foldably connected to a first edge of the handle panel;

wherein the first edge of the handle panel is distant from the handle opening;

wherein the first panel is a bottom panel which does not include any opening features, and wherein the at least one end flap is a bottom end flap.

2. The carton according to claim 1, further comprising a closure flap for closing the handle opening.

3. The carton according to claim 1, wherein a first edge of the first reinforcement panel extends along and is shaped substantially similar to at least a portion of a first edge of the handle opening.

4. The carton according to claim 1, further comprising:

a second reinforcement panel in an overlapping relationship with at least a second portion of the handle panel;

the second reinforcement panel is foldably connected to a second edge of the handle panel;

the second edge of the handle panel is distant from the handle opening; and the first and second edges of the handle panel are opposite from one another.

5. The carton according to claim 1, wherein:

the first reinforcement panel is adhered to the handle panel;

the plurality of panels, which extend at least partially around the interior of the carton, include a side panel;

the carton further includes at least one side end flap foldably connected to the side panel and at least partially closing an end of the carton; and the first reinforcement panel is releasably adhered to the at least one side end flap.

6. The carton according to claim 1, wherein:

the first reinforcement panel is adhered to the handle panel;

the plurality of panels, which extend at least partially around the interior of the carton, include a side panel;

the carton further includes at least one side end flap foldably connected to the side panel and at least partially closing an end of the carton;

the bottom end flap further includes an intermediate panel that is positioned between the bottom panel and the handle panel;

there is a connection between the intermediate panel and the side end flap;

there is a connection between the first reinforcement panel and the side end flap; and the connection between the intermediate panel and the side end flap is stronger than the connection between the first reinforcement panel and the side end flap.

7. The carton according to claim 1, wherein:

the plurality of panels, which extend at least partially around the interior of the carton, include a side panel;

the carton further includes at least one side end flap foldably connected to the side panel and at least partially closing an end of the carton; and the first reinforcement panel is separated from the side end flap by a tear line, so that the side end flap defines an opening at least partially resulting separation of the first reinforcement panel from the side end flap along the tear line.

8. A blank, comprising:

a plurality of panels that are respectively foldably connected to one another;

a first end flap foldably connected to a first panel of the plurality of panels along a first fold line, the first end flap being divided by a second fold line into a handle panel and an intermediate panel, the intermediate panel positioned between the first fold line and the second fold line; and a second end flap foldably connected to a second panel of the plurality of panels, wherein the first end flap at least partially defines a handle opening, and the second end flap includes a first reinforcement panel foldably connected to the handle panel;

a third end flap foldably connected to a third panel of the plurality of panels, wherein the first reinforcement panel is foldably connected to a first edge of the first end flap, wherein the third end flap includes a second reinforcement panel that is foldably connected to a second edge of the first end flap, and wherein the first and second edges of the first end flap are opposite from one another.

9. A method of forming a construct from a blank, the method comprising:

providing a blank having a plurality of panels that are respectively foldably connected to one another, a first end flap foldably connected to a first panel of the plurality of panels along a first fold line, and a second end flap foldably connected to a second panel of the plurality of panels, wherein the first end flap at least partially defines a handle opening, the first end flap being divided by a second fold line into a handle panel and an intermediate panel, the intermediate panel positioned between the first fold line and the second fold line, and the second end flap includes a first reinforcement panel that is foldably connected to the first end flap; and forming a reinforced handle, wherein the forming of the reinforced handle comprises arranging the first end flap and the first reinforcement panel in an overlapping arrangement with respect to one another so that the first reinforcement panel reinforces at least a portion of the handle panel proximate the handle opening, wherein the arranging comprises folding the first reinforcement panel relative to the first end flap;

wherein the first reinforcement panel does not overlap the intermediate panel when folded in the overlapping arrangement with the handle panel.

10. The method according to claim 9, wherein the arranging comprises striking the first reinforcement panel from the second end flap.

11. The method according to claim 9, further comprising:

pivoting the reinforced handle relative to other portions of the carton, and lifting the carton at least by the reinforced handle.

12. A method of forming a construct from a blank, the method comprising:

providing a blank having a plurality of panels that are respectively foldably connected to one another, a first end flap foldably connected to a first panel of the plurality of panels, and a second end flap foldably connected to a second panel of the plurality of panels, wherein the first end flap at least partially defines a handle opening, and the second end flap includes a reinforcement panel that is foldably connected to the first end flap;

forming a reinforced handle, wherein the forming of the reinforced handle comprises arranging the first end flap and the reinforcement panel in an overlapping arrangement with respect to one another so that the reinforcement panel reinforces at least a portion of the first end flap that is proximate the handle opening, wherein the arranging comprises folding the reinforcement panel relative to the first end flap; wherein the arranging comprises striking the reinforcement panel from the second end flap; and wherein the striking comprises tearing along at least one tear line that at least partially defines the reinforcement panel in the second end flap.

13. A method of forming a construct from a blank, the method comprising:

providing a blank having a plurality of panels that are respectively foldably connected to one another, a first end flap foldably connected to a first panel of the plurality of panels along a first fold line, and a second end flap foldably connected to a second panel of the plurality of panels, wherein the first end flap at least partially defines a handle opening, the first end flap being divided by a second fold line into a handle panel and an intermediate panel, the intermediate panel positioned between the first fold line and the second fold line, and the second end flap includes a first reinforcement panel that is foldably connected to the first end flap; and forming a reinforced handle, wherein the forming of the reinforced handle comprises arranging the first end flap and the first reinforcement panel in an overlapping arrangement with respect to one another so that the first reinforcement panel reinforces at least a portion of the handle panel proximate the handle opening, wherein the arranging comprises folding the first reinforcement panel relative to the first end flap;

wherein the separating comprises separating the reinforced handle at first and second glue locators.

14. The method according to claim 13 wherein the first and second glue locators tear away portions of the first reinforcement panel when separated.

15. A carton comprising:

a plurality of panels that extend at least partially around an interior of the carton, the plurality of panels including a first panel;

at least one end flap foldably connected to the first panel along a first fold line, the at least one end flap at least partially defining a handle opening; the at least one end flap being divided by a second fold line into a handle panel and an intermediate panel; the intermediate panel positioned between the first fold line and the second fold line; and a first reinforcement panel in an overlapping relationship with at least a first portion of the handle panel, wherein the reinforcement panel is proximate the handle opening, the reinforcement panel is foldably connected to an edge of the end flap, and the edge of the end flap is distant from the handle opening;

wherein the first reinforcement panel does not overlap the intermediate panel when folded in the overlapping arrangement with the handle panel.

16. A blank comprising:

a plurality of panels that are respectively foldably connected to one another;

a first end flap foldably connected to a first panel of the plurality of panels along a first fold line, the first end flap being divided by a second fold line into a handle panel and an intermediate panel, the intermediate panel positioned between the first fold line and the second fold line; and a second end flap foldably connected to a second panel of the plurality of panels, wherein the first end flap at least partially defines a handle opening, the second end flap includes a first reinforcement panel foldably connected to the handle panel;

wherein the first reinforcement panel is foldably connected to the handle panel along a second fold line and wherein the first reinforcement panel overlaps the handle panel and does not overlap the intermediate panel when folded along the second fold line.

* * * * *